US005564948A

United States Patent [19]

Harting et al.

[11] Patent Number: 5,564,948

[45] Date of Patent: Oct. 15, 1996

[54] SHIELDED, PRINTED CIRCUIT BOARD, PLUG-IN CONNECTION

[75] Inventors: Dietmar Harting, Espelkamp; Karin Foerster, Luebbecke; Guenter Pape, Bielefeld, all of Germany

[73] Assignee: Harting Elektronik GmbH, Espelkamp, Germany

[21] Appl. No.: 345,664

[22] Filed: Nov. 28, 1994

[30] Foreign Application Priority Data

Dec. 2, 1993 [DE] Germany ..... 43 41 104.5

[51] Int. Cl.[6] ..... H01R 13/648

[52] U.S. Cl. ..... 439/607; 439/931; 439/79

[58] Field of Search ..... 439/607, 931, 439/88, 79, 80, 696, 701, 78

[56] References Cited

U.S. PATENT DOCUMENTS 5,028,492 7/1991 Guenin ..... 439/931 X 5,035,649 7/1991 Collier et al. ..... 439/607 O 5,213,524 5/1993 Okamoto et al. ..... 439/604 X 5,228,871 7/1993 Goodman ..... 439/607 O

*Primary Examiner*—David L. Pirlot

*Assistant Examiner*—Daniel Wittels

*Attorney, Agent, or Firm*—Jordan & Hamburg

[57] ABSTRACT

A shielded printed circuit board plug-in connection and particularly a multipole socket plug-in connection includes a mating connector having a basic body provided with a conducting coating all around with the exception of the plug-in region and the region where the contact element ends emerge. The contact element ends facing the printed circuit board are covered with metallized caps and provided with conducting, elastic seals between the contacting areas of the caps and the printed circuit board or the basic body.

19 Claims, 9 Drawing Sheets

SHIELDED, PRINTED CIRCUIT BOARD, PLUG-IN CONNECTION

BACKGROUND OF THE INVENTION

The invention relates to a shielded, printed circuit board, plug-in connection and, in particular, to a multipole, socket, plug-in connection with a mating connector with contact sockets, which are inserted in recesses of an essentially rectangular basic: body consisting of insulating material and the ends of which are pin-shaped and inserted into appropriate boreholes of a printed circuit board and which extend at fight angles to the plug-in direction of the contact sockets, and with means for shielding the mating connector as well as its contact ends on the printed circuit board.

Such mating connectors are used for printed circuit board assemblies, for which signal leads are transferred over the signal contacts of the mating connector from a so-called rear-panel printed circuit board to the printed circuit board assemblies and for which the signal contacts of the mating connector must be shielded against external interfering effects. Moreover, the shielding of the signal contacts shall be as gapless as possible, that is, continuous shielding shall be ensured from the rear-panel printed circuit board over the mating connector to the printed circuit board assembly.

U.S. Pat. No. 4,836,791 discloses the providing of an insulating base of a mating connector, which has signal contacts, with flat, angular shielding plates, which cover the longitudinal sides of the mating connector and also overlap the contact connections, which protrude from the insulating base and are connected with the printed circuit board. The shielding plates are connected with strip conductors of the printed circuit board, which carry ground potential. When a connector is plugged into a corresponding mating connector, the shielding plates come into contact with contact parts carrying ground potential, shielding of the signal contacts of the connector being achieved. On the whole, this arrangement is satisfactory. However, it does not guarantee complete shielding of the connector, when shaped/folded shielding plates are used, which are not particularly complicated and which also overlap the narrow sides of the connector.

SUMMARY OF THE INVENTION

It is an object of the invention to develop a printed circuit board plug-in connection of the initially-mentioned type so that it has gapless shielding of the signal contacts of the mating connector as well as of the connection ends on the printed circuit board. Moreover, it shall be possible to produce the shielding inexpensively.

This object is accomplished owing to the fact that the outer surfaces of the basic body—with the exception of the plug-in side and the opposite side, out of which the contact socket ends protrude—are provided with a conductive coating, in that a cap of a plastic material is disposed over the contact socket ends protruding out of the basic body and faces the printed circuit board, the cap being constructed in such a way that, after being placed on one of the mating connectors mounted on the printed circuit board, it overlaps the contact socket ends of the mating connector completely and, moreover, on the one hand, rests on the rectangular basic body and, on the other, on the surface of the printed circuit board, at least the inside of the cap or the outside of the cap and the transition regions to the basic body as well as the frontal areas of the cap walls facing the printed circuit board being provided with a continuous, conductive coating, and in that elastic, electrically conducting seals are disposed between the cap and the covered area on the basic body, as well as between the cap and the printed circuit board surface, the printed circuit board surface, in the area coated with the seal, having an electrically conducting metallization, which can be connected to ground potential, in that on the opposite side of the printed circuit board, that is, on the side on which the contact socket ends protrude, a further cap is disposed, which covers the contact socket ends completely, rests on metallized regions of the printed circuit board, which can be connected to ground potential, an electrically conducting peripheral seal being disposed between the cap and the printed circuit board, and in that at least the inside or the outside of the cap and the frontal areas of the cap walls facing the printed circuit board are provided with a continuous, conductive coating.

The advantages, achieved with the invention, consist particularly therein that, due to the metallization (the conductive coating) of the basic body of the mating connector as well as of the caps, a complete, 360° all-around shielding of the signal contacts within the mating connector is achieved. Interposed, elastic, conductive seals ensure satisfactory sealing/shielding also at places of impact of the components. Plastic parts, provided with the conductive coating/the metallization, can be produced inexpensively, so that, despite possible complicated contours, advantageously priced shielding, satisfying even the highest demands, becomes possible.

An example of the invention is described in greater detail below and shown in the accompanying drawings.

DISCUSSION OF THE PREFERRED EMBODIMENTS

Figure 1:
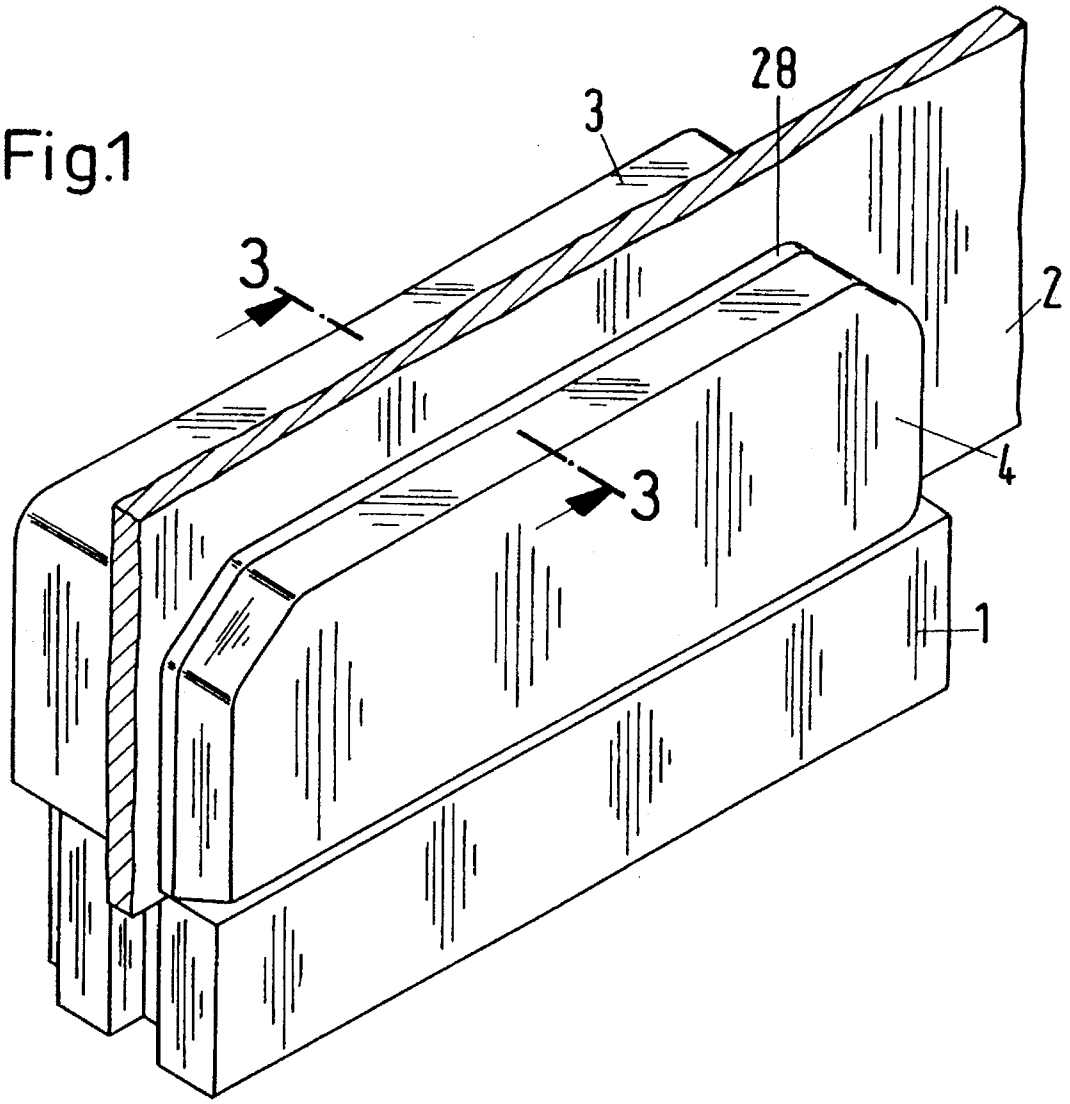
FIG. 1 shows a view of a printed circuit board plug-in connection.
Figure 2:
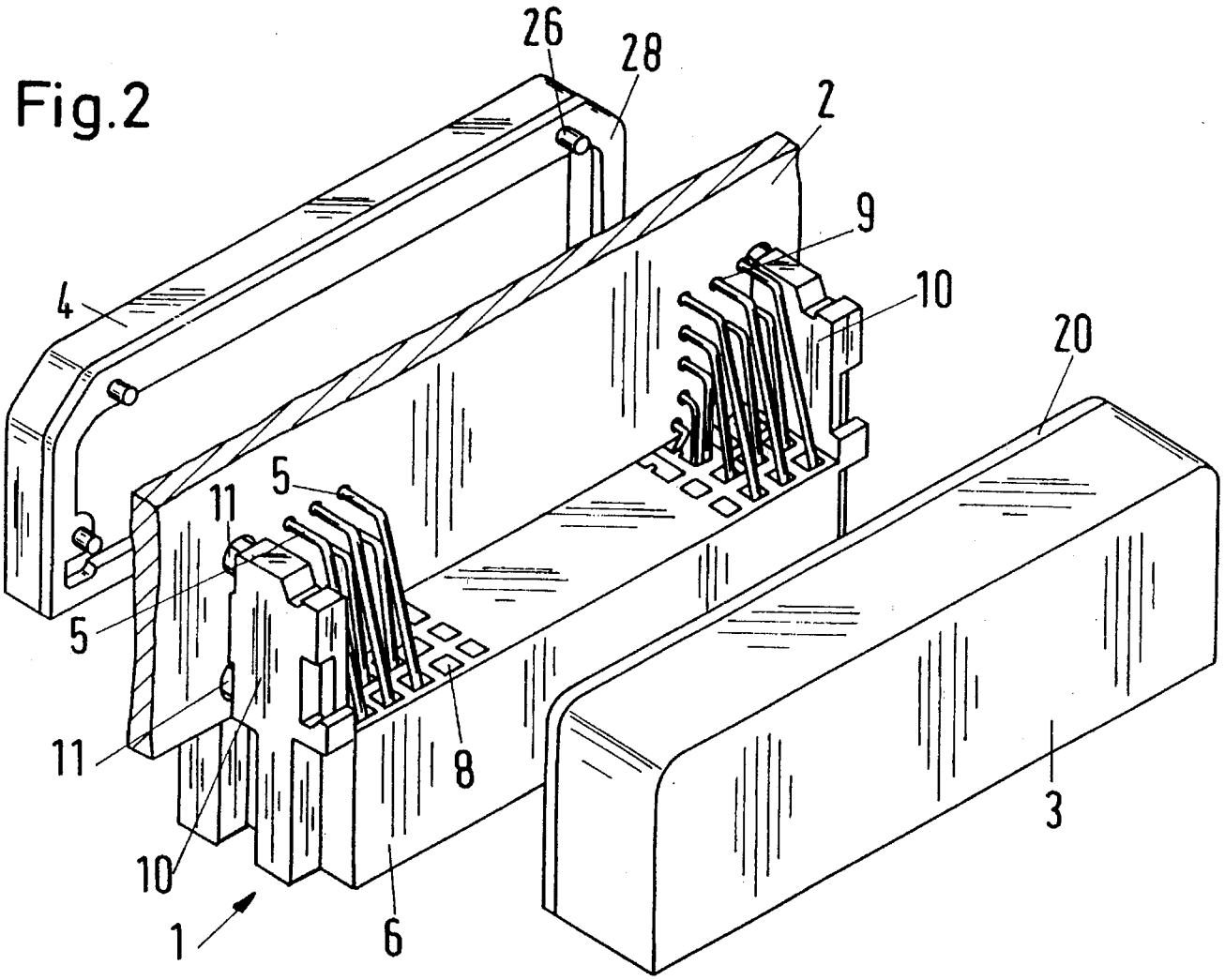
FIG. 2 shows a view of the printed circuit board plug-in connection of FIG. 1 in an exploded representation.

The printed circuit board plug-in connection, shown in FIGS. 1 and 2, consists essentially of a mating connector 1, which is mounted on a printed circuit board 2, as well as of a cap 3 and a cap 4, which are placed on the printed circuit board in such a manner, that they cover the contact socket ends 5 protruding from the mating connector.

Figure 3:
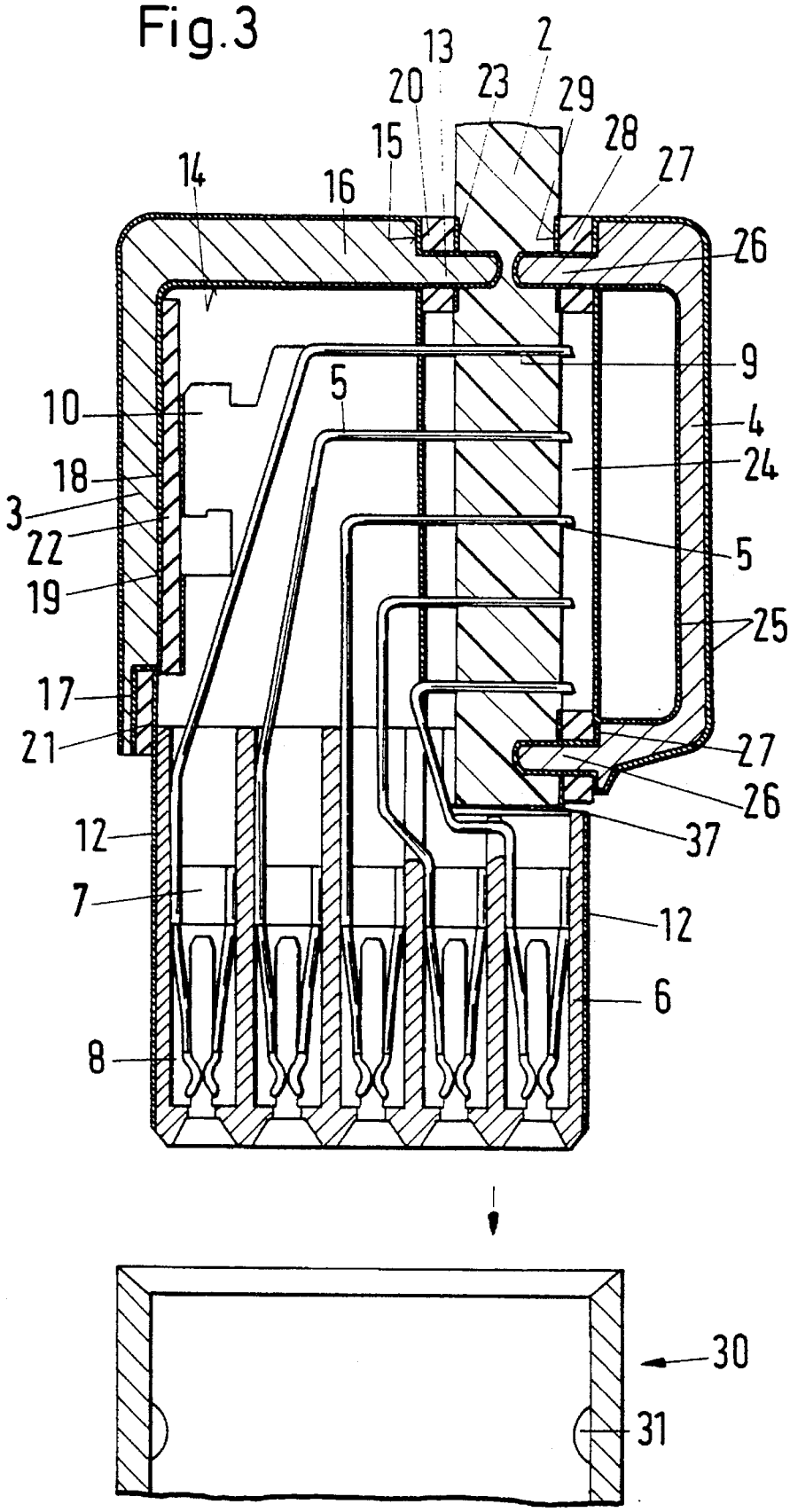
FIG. 3 shows a sectional view of the plug-in connection of FIG. 1, and FIGS. 4, 5, 6, 6A, 7, 7A show sectional views of modified printed circuit board plug-in connections.

The mating connector 1 has a basic body 6, which consists of a plastic material and into which contact sockets 7 are inserted in the usual manner in corresponding chambers 8, as shown in the sectional representation of FIG. 3. The contact socket ends 5 are angular and dip into boreholes 9 of the printed circuit board, in which they are soldered and connected with strip conductors. The basic body furthermore is provided with lateral flanges 10, the sides of which, facing the printed circuit board, are provided with pin-shaped projections 11, which are pressed into fastening boreholes in the printed circuit board. In order to achieve shielding of the contact elements of the mating connector, the outer surfaces of the basic body—with the exception of the plug-in side and the opposite side, out of which the contact socket ends 5 protrude—are provided with a conductive coating, preferably a metallization 12. The flanges 10 are also metallized. The metallization 12 can be electrically conductive by a galvanic coating (such as Cu/Ni, the Cu providing the conductivity and the Ni the corrosion protection) or by applying (brushing or spraying) conductive lacquers (a conventional lacquer with electrically conductive particles). A consistently uniform thickness of the coating on the metallic coating is desirable. The thickness of the galvanic coating may be generally about 0.1 to 0.2 mm and that of the conductive lacquer generally about 0.5 mm.

The two caps 3, 4 are provided since, by such a metallization, which is connected in a suitable manner—for example—over a continuous metallization also of the projections 11 of the flange 10, which are then inserted into metallized fastening boreholes connected to ground potential—with a ground potential, only the contact sockets 7 within the basic body 6 are shielded.

The cap 3 consists of a plastic material and is provided with a fastening pegs 13, which are pressed into the fastening boreholes in the printed circuit board 2. The cap 3 is constructed so that it covers the contact socket ends 5 protruding out of the mating connector 1, that is, after the cap is put in place, the region, in which the contact element ends protrude out of the mating connector, is covered in all directions, the cap resting, on the one hand, on the surface of the printed circuit board and, on the other, on the basic body 6 and also on the flanges 10.

At least on its inside 14 or optionally on its outside and the frontal areas 15 of the cap walls 16 as well as in the region 17 where it rests on the basic body 6 and the region 18, in which it rests on the flanges 10, the cap 3 is provided with a continuously, coherent, conductive coating, preferably, a metallization 19. Provisions can also be made that the whole of the surface, inside as well as outside, is provided with a metallization. To achieve a tight connection between the cap 3 and the printed circuit board 2 or the basic body 6, conductive, elastic seals 20, 21, 22 are provided between the frontal areas 15 of the cap and the printed circuit board 2, as well as in the region 17, where the cap rests on the basic body 6 and in the region 18, where the inside 14 of the cap rests on the flange 10. The conductive seals are elastic seals (for example, of sponge rubber or silicone rubber) which have been made electrically conductive, for example, by the incorporation of graphite or similar conductive particles. The printed circuit board 2 is provided with a metallization 23 connected to ground potential in the resting region of the cap 3 or of the seal 20, so that continuous shielding of the contact elements of the mating connector is achieved.

In order to shield also the region 24 of the printed circuit board 2, from which the contact element ends 5 protrude, a further cap 4 is provided which, closed off all-around, covers also this region. This cap, in much the same way as cap 3, is also provided with a metallization 25, and fastening pegs 26 at the frontal areas 27 of the cap 4 are pressed into corresponding fastening boreholes of the printed circuit board 2. Here also, an elastic, conductive seal 28 is inserted between the frontal areas 27 of the cap walls and the printed circuit board, which is also provided in this region with a metallization 29 connected to ground potential.

Due to the metallized basic body 6 and the two caps 3, 4, absolutely complete shielding of the contact elements is thus achieved, the elastic, conductive seals 20, 21, 22, 28 bringing it about that there are no unwanted air gaps at the transition sites of the various components. The elastic seals 20, 21, 22, 28 buffer the parts elastically, that is, seals them elastically, in order to maintain an elastic pressure. Because the material of the elastic seals 20, 21, 22, 28 at the same time is electrically conductive, a defined contact is ensured between the parts abutting the elastic seals. For the sake of completeness, a mating connector 30 is indicated in FIG. 3. On uniting the mating connector, contact regions 31, which are provided on this mating connector, are connected with the metallized surface of the basic body and a continuation of the shielding in the mating connector is achieved. An example of such a mating connector is disclosed in copending U.S. patent application entitled "Electrical Mating Connector", U.S. Pat. No. 5,509,823, of the same three inventors as this instant application and which is being filed in the U.S. Patent and Trademark Office on the same day as this instant application, said copending application being incorporated herein by reference.

Figure 4:
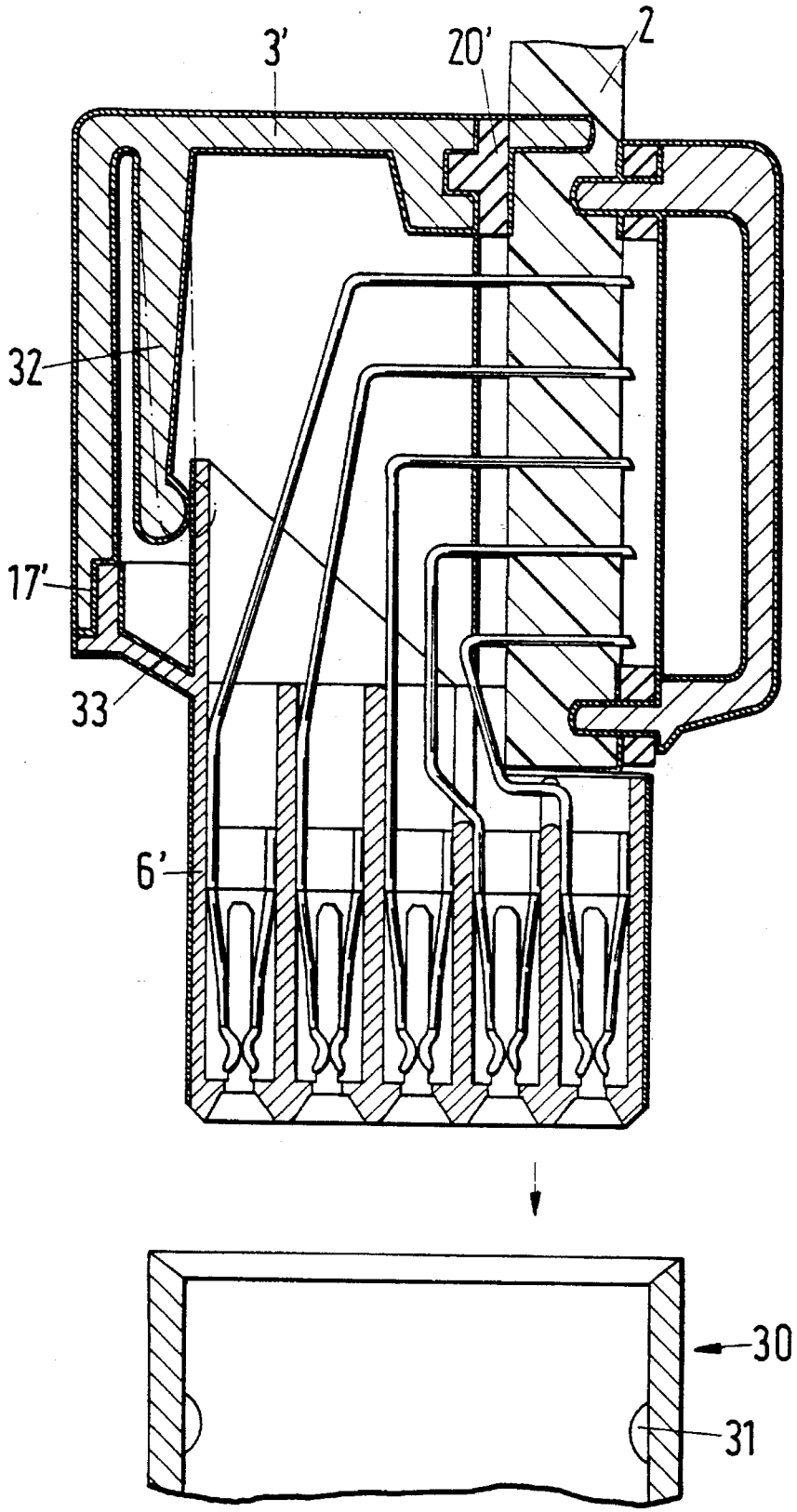

In FIG. 4, a modified printed circuit board plug-in connection is shown in section. The inner region of the cap 3' is provided here with integrally molded elastic contact tongues 32, which have a metallization connected with the remaining metallization of the cap. When the cap 3' is installed, these contact tongues press on correspondingly extended regions 33 of the basic body 6'. These regions are also provided with a metallization, which is connected with the remaining metallization of the supporting body. The region 17', where the cap rests on the basic body 6', is tiered, so that it is unnecessary to insert a special seal here. However, this region is also provided with a metallization connected with the remaining metallization. The quasi form-fitting transition prevents a gap, which could diminish the shielding in this region, being present when the cap and supporting body are assembled.

A likewise modified seal 20' is used here as seal between the cap 3' and the printed circuit board 2. The seal is inserted in a groove in the frontal area of the cap and has a T-shape. The elastic contact tongues of this cap can compensate for any manufacturing tolerances that may arise, satisfactory contact between the metallizations always being ensured.

Figure 5:
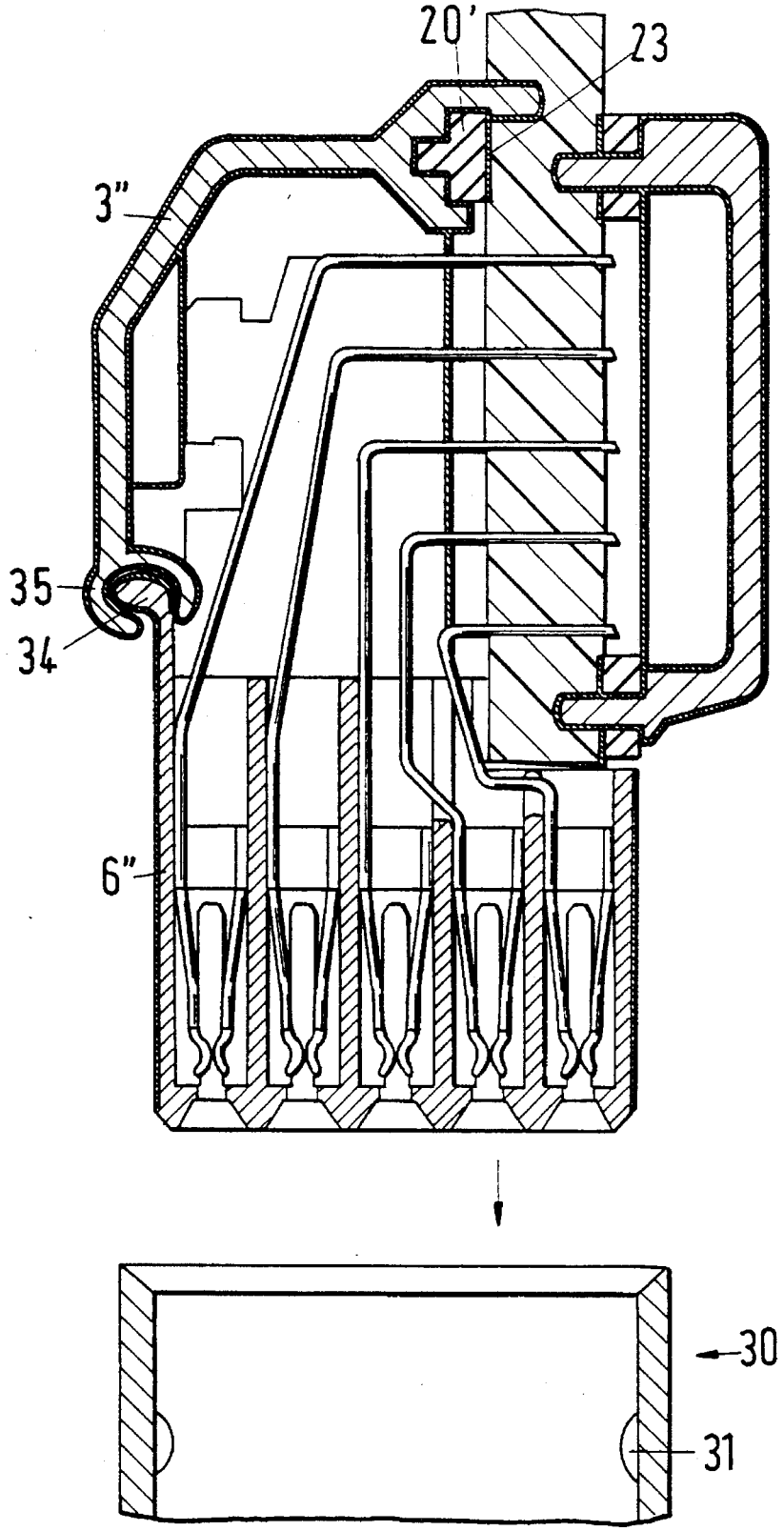

In FIG. 5, a further modified printed circuit board plug-in connection is shown in section. The cap 3" is connected positively with the supporting body 6". The longitudinal side of the basic body is provided with a bead-like edge 34 and the region 35 of the cap 3", facing this edge 34, is forked and snapped onto the edge. The edge 34 and the fork-like region 35 are provided with a metallization, which is connected with the remaining metallization of the parts. The sides of the cap 3" are "pulled down" to the printed circuit board and their metallization is connected electrically conductive through the interposed seal 20' with the metallization 23 of the printed circuit board.

Figure 6:
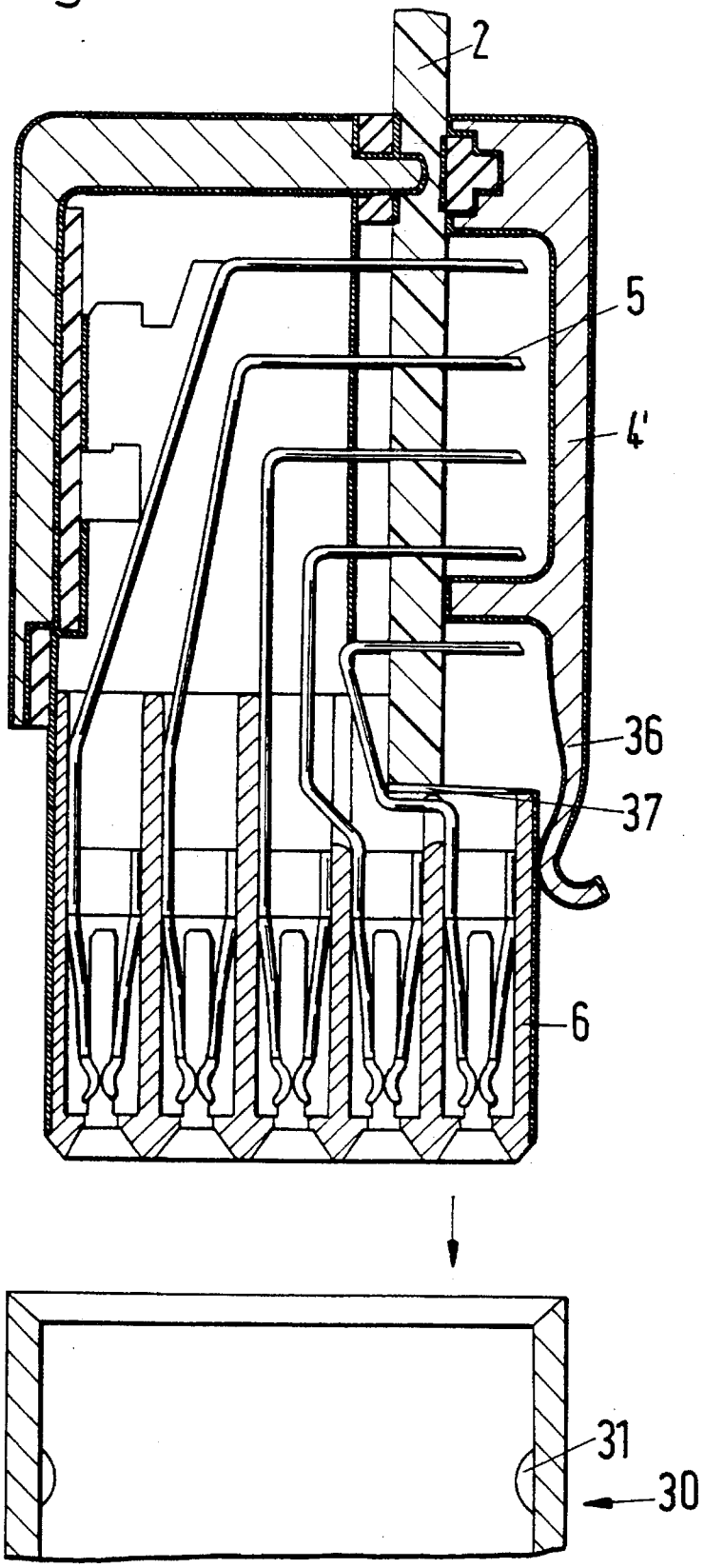

In FIG. 6, a further modified printed circuit board plug-in connection is shown, for which a modified cap 4' is used for shielding the contact socket ends 5 protruding out of the printed circuit board 2. The cap is provided here with an elastic, flexible molding/extension 36, which protrudes into the region of the basic body 6 and lies on this so as to make contact. It is self evident that the regions making contact are provided with an electrically conducting coating, which is connected in each case with the remaining metallized regions of the parts.

An elastic, here T-shaped, conductive seal in a groove of the frontal areas of the cap ensures also for this embodiment that the cap has a peripheral connection with the printed circuit board and that the contact socket ends 5 are shielded all around.

Figure 6A:
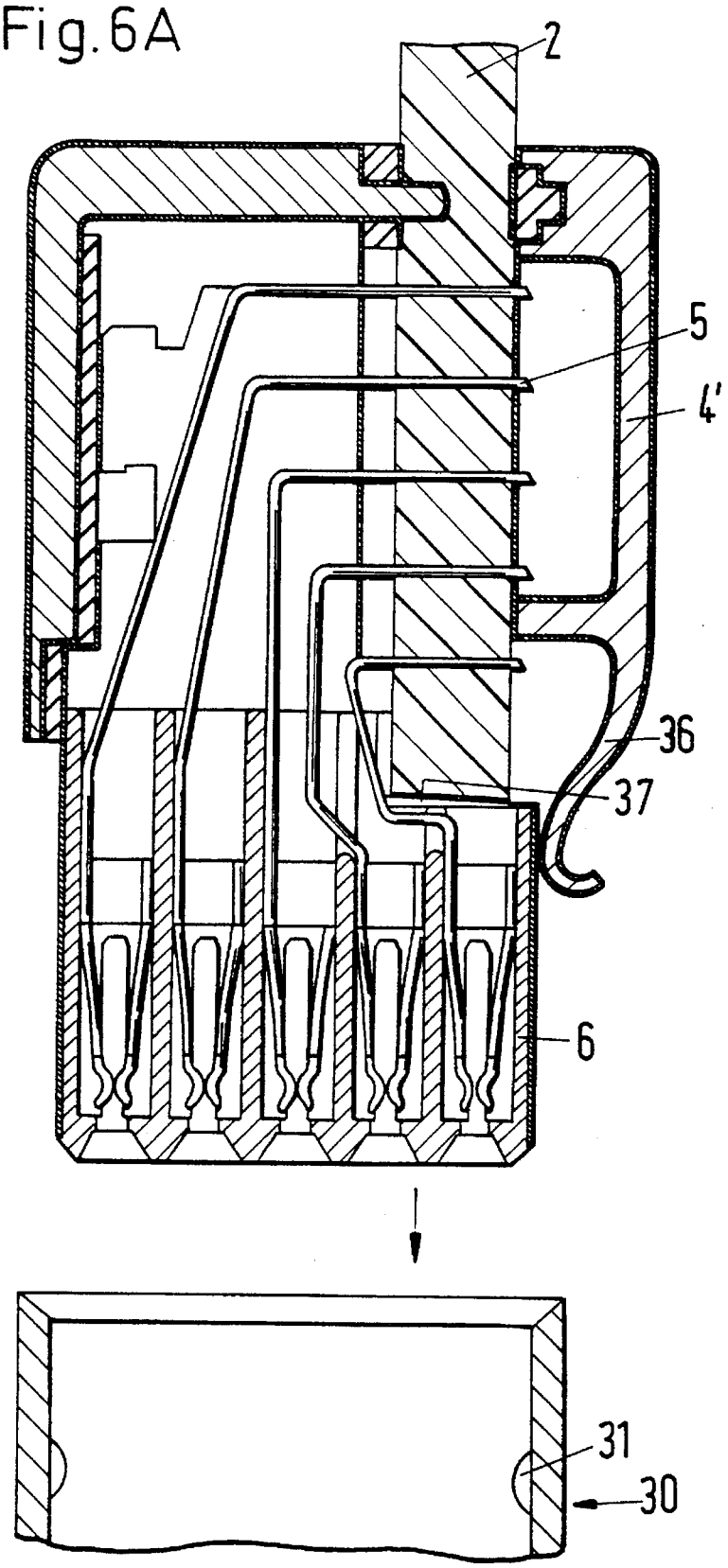

With this embodiment, on the one hand, the gap 37 between the printed circuit board ends and the basic body is also enclosed by the shielding without special "sealing materials" having to be inserted and, on the other, it is also readily possible, due to the elastic molding, to use printed circuit boards with different thicknesses, as shown, for example, by the fact that the thickness of the printed circuit board is greater in FIG. 6A than in FIG. 6.

Figure 7:
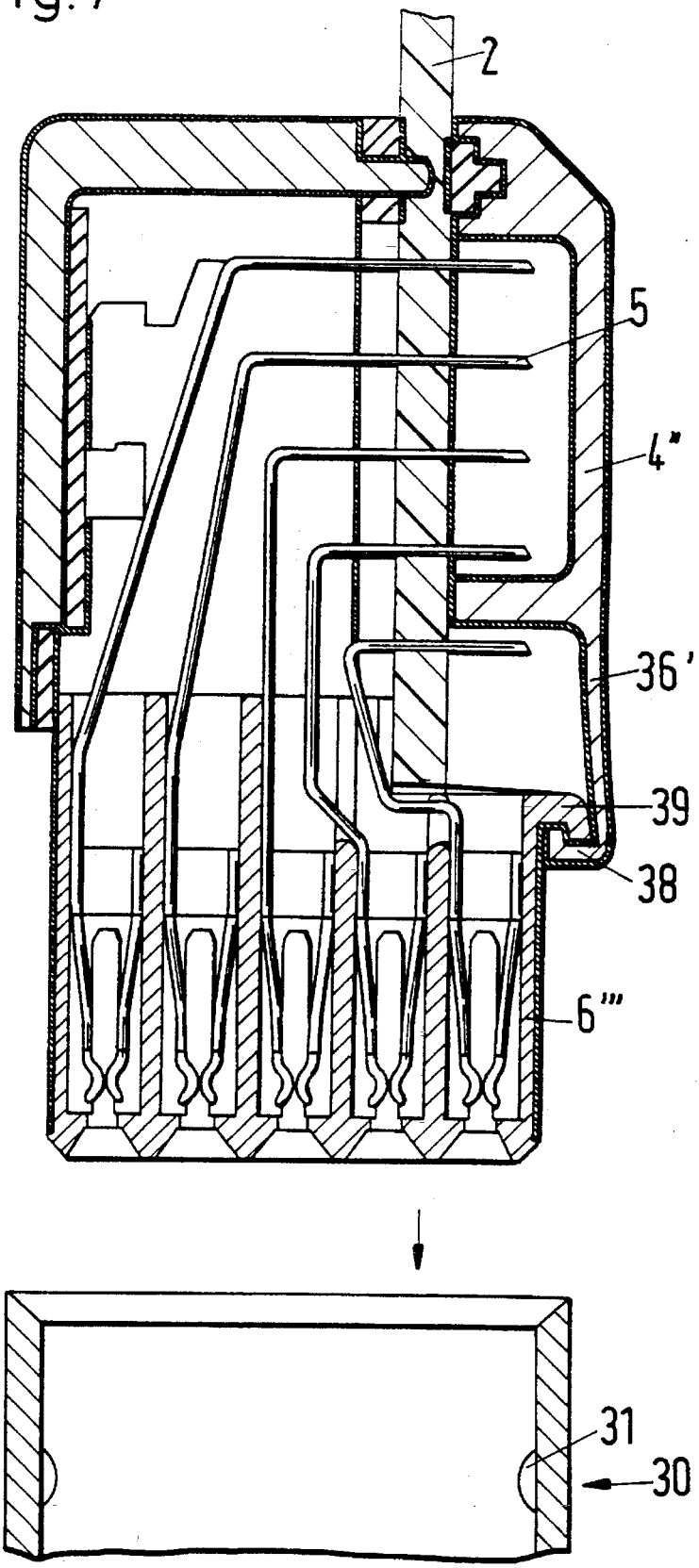
Figure 7A:
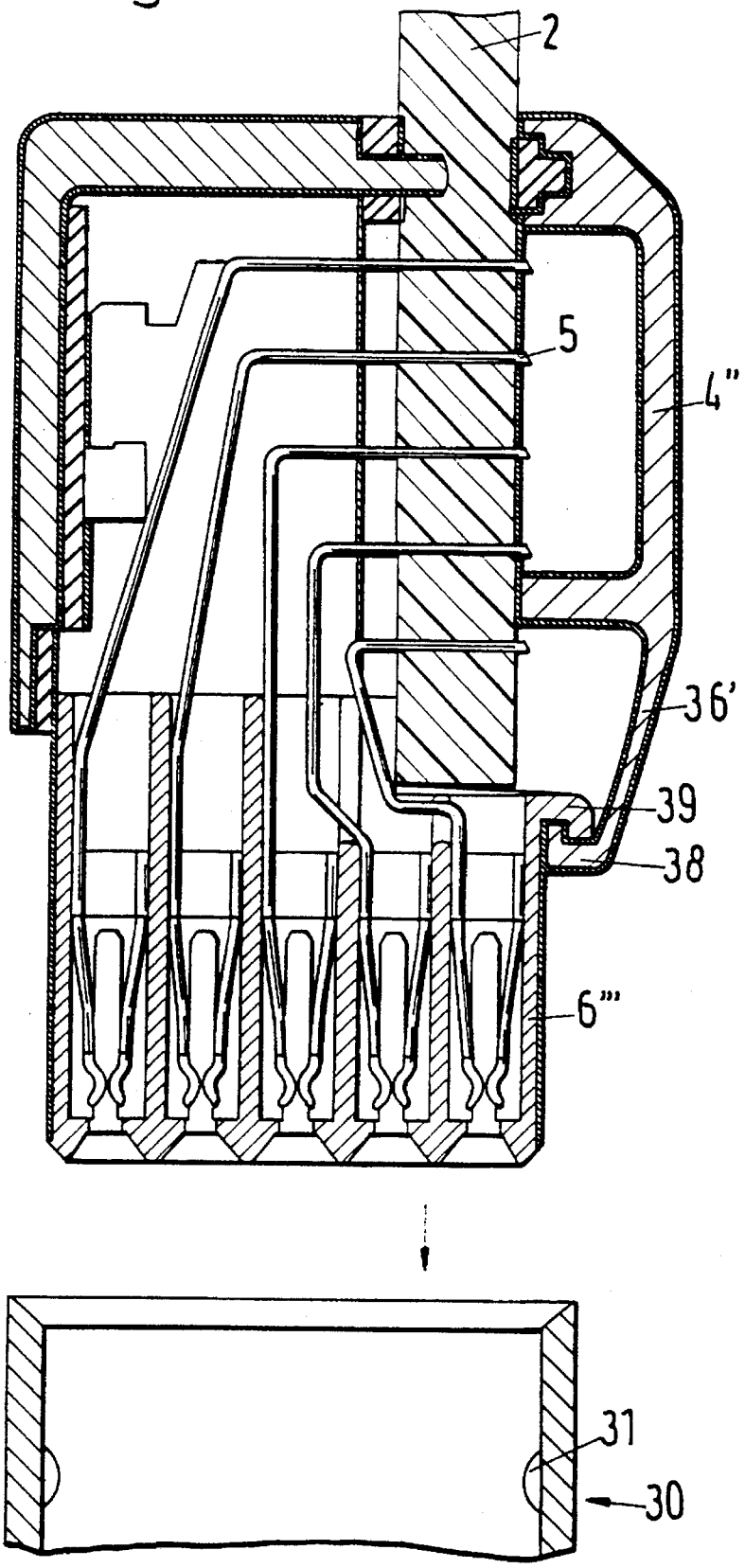

In FIGS. 7 and 7A, a further modified printed circuit board plug-in connection is shown, for which a modified cap 4" is used to shield the contact socket ends 5 protruding out of the printed circuit board 2. Here also, the cap is provided with an elastic, flexible molding/extension 36'. However, the end 38 of the molding/extension 36' is hook-shaped and suspended behind a corresponding, hook-shaped molding 39 at the basic body 6''' so that a positive connection between the basic body and the cap is achieved here. Of course, the corresponding contacting surfaces are also to be provided here with metallizations or conductive coatings, in order to achieve continuous shielding. The use of a cap 4" with a printed circuit board of greater thickness is shown in the representation of FIG. 7A.

For the sake of completeness, it is mentioned that the cap constructions described above can also be used in different combinations.

What we claim is:

1. An electrical connector for a circuit board operable to be connected with a mating connector comprising a connector body made of an insulating material, receiving sockets in said connector body, said receiving sockets each having a longitudinal socket axis generally parallel to one another, said circuit board having first and second faces generally parallel to one another and to said receiving socket axes, conductors having first conductor portions extending from said receiving sockets to said circuit board, said conductors having second conductor portions passing through said circuit board and which penetrate said first face at a first face section and which penetrate said second face at a second face section, said second conductor portions passing through :said circuit board generally perpendicular to said receiving socket axes, a first plastic cap extending over said first conductor portions and over said first face section of said circuit board, a first conductive coating on said first cap, a first elastic and electrically conductive sealing means between said first cap and said connector body and between said first cap and said circuit board, a second plastic cap extending over said second face section of said circuit board, a second conductive coating on said second cap, and a second elastic and electrically conductive sealing means between said second cap and said circuit board, said connector body having an outer surface generally parallel to said receiving socket axes, and a third conductive coating on said outer surface of said connector body.

2. An electrical connector according to claim 1 further comprising elastic tongues on said first cap biasingly contacting said connector body.

3. An electrical connector according to claim 2 wherein said tongues are integrally formed with said first cap.

4. An electrical connector according to claim 3 wherein said first conductive coating extends over said fastening pegs.

5. An electrical connector according to claim 2 wherein said tongues biasingly engage an engaging surface on said connector body, said first conductive coating extending over said tongue, said third conductive coating extending over said engaging surface.

6. An electrical connector according to claim 1 wherein said second cap has fastening pegs, said circuit board having a bore hole receiving said fastening pegs.

7. An electrical connector according to claim 6 wherein said second conductive coating extends over said fastening pegs.

8. An electrical connector according to claim 1 wherein said second cap has an integrally formed cap extension which extends onto said outer surface of said connector body and which engages said outer surface of said connector body, said cap extension having elastic properties such that said cap extension biasingly engages said outer surface of said connector body, said second conductive coating extending over said cap extension.

9. An electrical connector according to claim 1 wherein said connector body has flanges on which said first cap is mounted, said first elastic and electrically conducting sealing means comprising an elastic and conductive sealing material between said first cap and said flanges.

10. An electrical connector according to claim 1 wherein said connector body has projections received in openings in said circuit board, said third conductive coating extending over said projections.

11. An electrical connector according to claim 1 wherein said first cap has fastening pegs, said circuit board having bore hole receiving said fastening pegs.

12. An electrical connector according to claim 1 wherein said second cap has an integrally formed cap extension which extends onto said outer surface of said connector body and which engages said outer surface of said connector body, said second conductive coating extending over said cap extension.

13. An electrical connector according to claim 12 wherein said cap extension has elastic properties.

14. An electrical connector according to claim 12 wherein said cap extension has one part engageable with another part of said connector body, one of said parts having a groove, the other of said parts having a projection extending into said groove.

15. An electrical connector according to claim 14 wherein one of said second and third conductive coatings extends into said groove, the other of said second and third conductive coatings extending about said projection.

16. An electrical connector for a circuit board operable to be connected with a mating connector comprising a connector body made of an insulating material, receiving sockets in said connector body, said receiving sockets each having a longitudinal socket axis generally parallel to one another, said circuit board having first and second faces generally parallel to one another and to said receiving socket axes, conductors having first conductor portions extending from said receiving sockets to said circuit board, said conductors having second conductor portions passing through said circuit board and which penetrate said first face at a first face section and which penetrate said second face at a second face section, said second conductor portions passing through said circuit board generally perpendicular to said receiving socket axes, a first plastic cap extending over said first conductor portions and over said first face section of said circuit board, a first conductive coating on said first cap, a first elastic and electrically conductive sealing means between said first cap and said connector body and between said first cap and said circuit board, said first elastic and electrically conductive sealing means comprising a generally U-shaped part on one of said first cap and connector body and a projecting part on the other of said first cap and connector body with said projecting part being disposed in said U-shaped part, a second plastic cap extending over said second face section of said circuit board, a second conductive coating on said second cap, and a second elastic and electrically conductive sealing means between said second cap and said circuit board, said connector body having an outer surface generally parallel to said receiving socket axes, and a third conductive coating on said outer surface of said connector body.

17. An electrical connector according to claim 16 wherein said U-shaped part is constructed to flex such that when said projecting part is disposed in said U-shaped part, said U-shaped part flexes and biasingly retains said projecting part in said U-shaped part.

18. An electrical connector according to claim 17 wherein said first conductive coating extends onto said U-shaped member, wherein said third conductive coating extending over said projecting part.

19. An electrical connector according to claim 16 wherein said first elastic and electrically conductive sealing means comprises elastic and electrically conductive material between said U-shaped part and said projecting part.

* * * * *